US007396220B2

(12) United States Patent
Delpassand et al.

(10) Patent No.: US 7,396,220 B2
(45) Date of Patent: Jul. 8, 2008

(54) PROGRESSING CAVITY STATOR INCLUDING AT LEAST ONE CAST LONGITUDINAL SECTION

(75) Inventors: Majid S. Delpassand, Houston, TX (US); Dennis Sell Norton, Spring, TX (US)

(73) Assignee: Dyna-Drill Technologies, Inc., Houston, TX (US)

( * ) Notice: Subject to any disclaimer, the term of this patent is extended or adjusted under 35 U.S.C. 154(b) by 192 days.

(21) Appl. No.: 11/085,910

(22) Filed: Mar. 21, 2005

(65) Prior Publication Data

US 2006/0182644 A1 Aug. 17, 2006

Related U.S. Application Data

(63) Continuation-in-part of application No. 11/056,674, filed on Feb. 11, 2005, now abandoned.

(51) Int. Cl.
*F01C 1/10* (2006.01)
*F01C 5/00* (2006.01)

(52) U.S. Cl. ..... 418/48; 418/220; 418/153

(58) Field of Classification Search ..... 418/48, 418/220, 153

See application file for complete search history.

(56) References Cited

U.S. PATENT DOCUMENTS 3,912,426 A * 10/1975 Tschirky ..... 418/48
3,975,120 A * 8/1976 Tschirky ..... 418/48
3,975,121 A 8/1976 Tschirky
4,144,001 A 3/1979 Streicher
5,171,138 A * 12/1992 Forrest ..... 418/48
5,439,359 A * 8/1995 Leroy et al. ..... 418/48
5,474,432 A * 12/1995 Hulley et al. ..... 418/48
5,832,604 A * 11/1998 Johnson et al. ..... 29/888.023
6,241,494 B1 * 6/2001 Pafitis et al. ..... 418/48
6,293,358 B1 9/2001 Jager
6,309,195 B1 10/2001 Bottos et al.
6,543,132 B1 4/2003 Krueger et al.
6,604,922 B1 8/2003 Hache
6,881,045 B2 4/2005 Zitka et al.
2005/0079083 A1 * 4/2005 Lievestro et al. ..... 418/48
2005/0118040 A1 6/2005 Zitka et al.

* cited by examiner

*Primary Examiner*—Thomas Denion
*Assistant Examiner*—Douglas J. Duff

(57) ABSTRACT

A progressing cavity stator and a method for fabricating such a stator are disclosed. Exemplary embodiments of the progressing cavity stator include a plurality of rigid longitudinal stator sections concatenated end-to-end in a stator tube. The stator sections are rotationally aligned so that each of the internal lobes extends in a substantially continuous helix from one end of the stator to the other. The stator further includes an elastomer liner deployed on an inner surface of the concatenated stator sections. Exemplary embodiments of this invention include a comparatively rigid stator having high torque output and are relatively simple and inexpensive to manufacture as compared to prior art rigid stators.

18 Claims, 5 Drawing Sheets

PROGRESSING CAVITY STATOR INCLUDING AT LEAST ONE CAST LONGITUDINAL SECTION

RELATED APPLICATIONS

This application is a continuation-in-part of co-pending, commonly-invented and commonly-assigned U.S. patent application Ser. No. 11/056,674 entitled Progressing Cavity Stator Having A Plurality Of Cast Longitudinal Sections, filed Feb. 11, 2005.

FIELD OF THE INVENTION

The present invention relates generally to positive displacement progressing cavity drilling motors, typically for downhole use. This invention more specifically relates to a progressing cavity stator having a plurality of cast longitudinal sections.

BACKGROUND OF THE INVENTION

Progressing cavity hydraulic motors and pumps (also known in the art as Moineau style motors and pumps) are well known in subterranean drilling and artificial lift applications, such as for oil and/or gas exploration. Such progressing cavity motors make use of hydraulic power from drilling fluid to provide torque and rotary power, for example, to a drill bit assembly. The power section of a typical progressing cavity motor includes a helical rotor disposed within the helical cavity of a corresponding stator. When viewed in circular cross section, a typical stator shows a plurality of lobes in the helical cavity. In most conventional Moineau style power sections, the rotor lobes and the stator lobes are preferably disposed in an interference fit, with the rotor including one fewer lobes than the stator. Thus, when fluid, such as a conventional drilling fluid, is passed through the helical spaces between rotor and stator, the flow of fluid causes the rotor to rotate relative to the stator (which may be coupled, for example, to a drill string). The rotor may be coupled, for example, through a universal connection and an output shaft to a drill bit assembly. Alternatively, in pump applications, the rotor may be driven by, for example, electric power, in which case fluid may be caused to flow through the progressing cavities.

Conventional stators typically include a helical cavity component bonded to an inner surface of a steel tube. The helical cavity component in such conventional stators typically includes an elastomer (e.g., rubber) and provides a resilient surface with which to facilitate the interference fit with the rotor. Many stators are known in the art in which the helical cavity component is made substantially entirely of a single elastomer layer.

It has been observed that during operations, the elastomer portions of conventional stator lobes are subject to considerable cyclic deflection, due at least in part to the interference fit with the rotor and reactive torque from the rotor. Such cyclic deflection is well known to cause a significant temperature rise in the elastomer. The temperature rise is known to degrade and embrittle the elastomer, eventually causing cracks, cavities, and other types of failure in the lobes. Such elastomer degradation is known to reduce the expected operational life of the stator and necessitate premature replacement thereof. Moreover, the cyclic deflection is also known to reduce torque output and drilling efficiency in subterranean drilling applications. One solution to this problem has been to increase the length of power sections utilized in such subterranean drilling applications. However, increasing stator length tends to increase fabrication complexity and may also tend to increase the distance between the drill bit and downhole logging sensors. It is generally desirable to locate logging sensors as close as possible to the drill bit, since they are intended to monitor at-bit conditions, and they tend to monitor conditions that are remote from the bit when located distant from the bit.

Stators including a comparatively rigid helical cavity component have been developed to address these problems. For example, U.S. Pat. No. 5,171,138 to Forrest and U.S. Pat. No. 6,309,195 to Bottos et al. disclose stators having helical cavity components in which a thin elastomer liner is deployed on the inner surface of a rigid, metallic stator former. The '138 patent discloses a rigid, metallic stator former deployed in a stator tube. The '195 patent discloses a "thick walled" stator having inner and outer helical stator profiles. The use of such rigid stators is disclosed to preserve the shape of the stator lobes during normal operations (i.e., to prevent lobe deformation) and therefore to improve stator efficiency and torque transmission. Moreover, such metallic stators are also disclosed to provide greater heat dissipation than conventional stators including elastomer lobes.

While comparatively rigid stators have been disclosed to improve the performance of downhole power sections (e.g., to improve torque output), fabrication of such rigid stators is complex and expensive as compared to that of the above described conventional elastomer stators. Most fabrication processes utilized to produce long, internal, multi-lobed helixes are tooling intensive (such as helical broaching) and/or slow (such as electric discharge machining). As such, rigid stators of the prior art are often only used in demanding applications in which the added expense is acceptable.

Various attempts have been made to address the above-mentioned difficulties associated with rigid stator fabrication. For example, U.S. Pat. No. 6,543,132 to Krueger et al. discloses methods for forming a rigid stator about an inner mandrel having a helical outer surface. The mandrel is then removed leaving a longitudinal member having an inner profile defined by the outer profile of the mandrel. U.S. Pat. No. 5,832,604 to Johnson et al. discloses a rigid stator formed of a plurality of duplicate disks including an inner cavity having a plurality of lobes. The discs are assembled into the form of a stator by stacking on a mandrel such that the discs are progressively rotationally offset from one another. The stack is then deployed in a stator tube. U.S. Pat. No. 6,241,494 to Pafitis et al. discloses a non elastomeric stator including a plurality of stainless steel sections that are aligned and welded together to form a stator of conventional length. Nevertheless, despite these efforts, there exists a need for yet further improved stators for progressing cavity drilling motors, and in particular improved rigid stators and methods for fabricating such rigid stators.

SUMMARY OF THE INVENTION

The present invention addresses one or more of the above-described drawbacks of prior art Moineau style motors and/or pumps (also referred to as progressing cavity motors and pumps). Aspects of this invention include a progressing cavity stator for use in such motors and/or pumps, such as in a downhole drilling assembly. Progressive cavity stators embodiments of this invention include at least one longitudinal stator section deployed in an outer stator tube. In exemplary embodiments, the stator includes a plurality of substantially identical longitudinal stator sections concatenated end-to-end in a stator tube. In such exemplary embodiments, the stator sections are rotationally aligned with one another in the stator tube such that a plurality of helical lobes extend in a substantially continuous helix from one end of the stator to the other. Exemplary stator embodiments further include a resilient elastomer liner deployed on an inner surface of comparatively rigid stator sections.

Exemplary embodiments of the present invention advantageously provide several technical advantages. For example, exemplary embodiments of this invention include a rigid stator having high torque output. Moreover, exemplary embodiments of this invention are relatively simple and inexpensive to manufacture as compared to prior art rigid stators. Various embodiments of this invention may also promote field service flexibility. For example, worn or damaged stator sections may be replaced in the field at considerable savings of time and expense. Alternatively, stator sections may be replaced, for example, to optimize power section performance (e.g., with respect to speed and power).

In one aspect, this invention includes a progressing cavity stator. The stator includes an outer stator tube having a longitudinal axis and a helical cavity component deployed substantially coaxially in the stator tube. The helical cavity component includes a plurality of rigid longitudinal stator sections concatenated end-to-end in the stator tube. Each of the stator sections provides an internal helical cavity and includes a plurality of internal lobes. The stator sections are rotationally aligned with one another so that each of the internal lobes extends in a substantially continuous helix from one longitudinal end of the stator to an opposing longitudinal end of the stator. The stator sections are rotationally restrained to substantially prevent relative rotation thereof about the longitudinal axis. Moreover, the stator sections are further retained by and secured in the stator tube to substantially prevent rotation of the stator sections about the longitudinal axis relative to the stator tube. The helical cavity component further includes an elastomer liner deployed on an inner surface of the concatenated stator sections.

In another aspect, this invention includes a progressive cavity stator. The stator includes an outer stator tube having a longitudinal axis and a helical cavity component deployed substantially coaxially in the stator tube. The helical cavity component includes first and second longitudinal portions. The first longitudinal portion includes at least one rigid longitudinal stator section deployed in the stator tube, the at least one stator section retained by and secured in the stator tube to substantially prevent rotation of the at least one stator section about the longitudinal axis relative to the stator tube. The at least one stator section reinforces an elastomer liner, which is deployed on an internal helical surface of the at least one stator section. The second portion of the helical cavity component includes an elastomer layer deployed in and retained by the stator tube. The elastomer liner in the first portion is substantially continuous with the elastomer layer in the second portion such that the helical cavity component provides an internal helical cavity and such that the helical cavity component includes a plurality of lobes, each of which extends in a substantially continuous helix from one longitudinal end of the stator to another longitudinal end of the stator.

In still another aspect, this invention includes a method for fabricating a progressing cavity stator. The method includes casting a plurality of stator sections, the stator sections providing an internal helical cavity and including a plurality of internal helical lobes. The method further includes concatenating the stator sections end-to-end on a helical mandrel such that each of the internal helical lobes extends in a substantially continuous helix from one longitudinal end of the concatenated stator sections to an opposing longitudinal end of the concatenated stator sections. The helical mandrel, including said concatenated stator sections, is then deployed in a preheated stator tube. The stator tube is cooled, thereby heat shrinking it about the concatenated stator sections. The stator sections are both secured in the stator tube and restrained from relative rotation by the heat shrunk stator tube. The method further includes removing the helical mandrel from the concatenated stator sections and deploying an elastomer liner on an inner surface of said concatenated stator sections.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
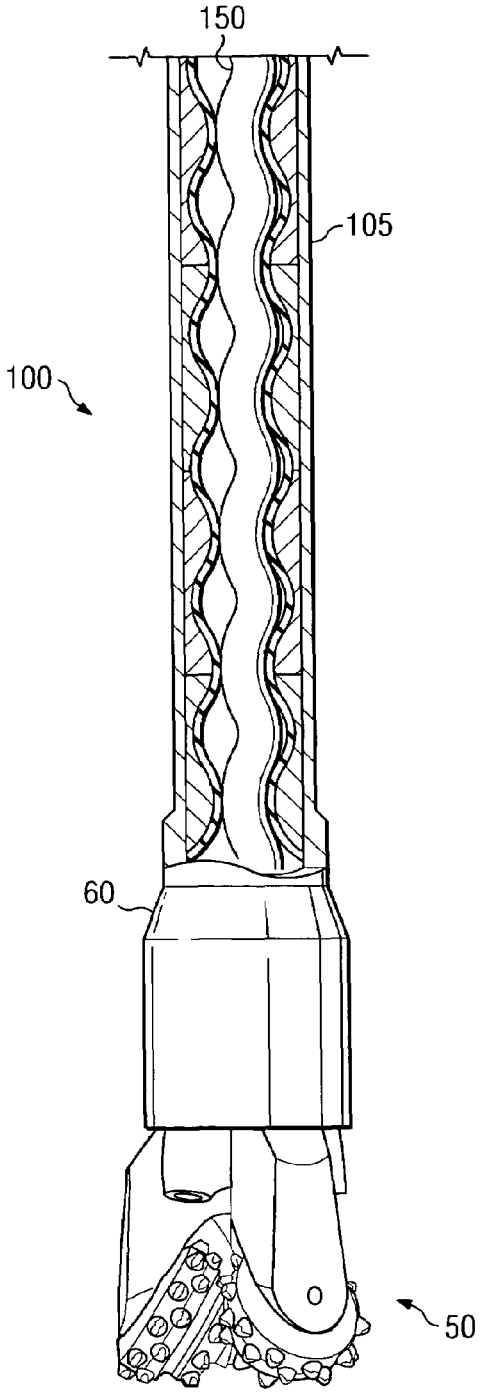
FIG. 1 depicts a conventional drill bit coupled to a progressing cavity motor utilizing an exemplary stator embodiment of the present invention including a plurality of stator sections.

FIG. 1 illustrates one exemplary embodiment of a progressing cavity power section 100 according to this invention in use in a downhole drilling motor 60. Drilling motor 60 includes a helical rotor 150 deployed in the helical cavity of progressing cavity stator 105. In the embodiment shown on FIG. 1, drilling motor 60 is coupled to a drill bit assembly 50 in a configuration suitable, for example, for drilling a subterranean borehole, such as in an oil and/or gas bearing formation. It will be understood that the progressing cavity stator 105 of this invention, while shown coupled to a drill bit assembly in FIG. 1, is not limited to downhole applications, but rather may be utilized in substantially any application in which progressing cavity hydraulic motors and/or pumps are used.

Figure 2:
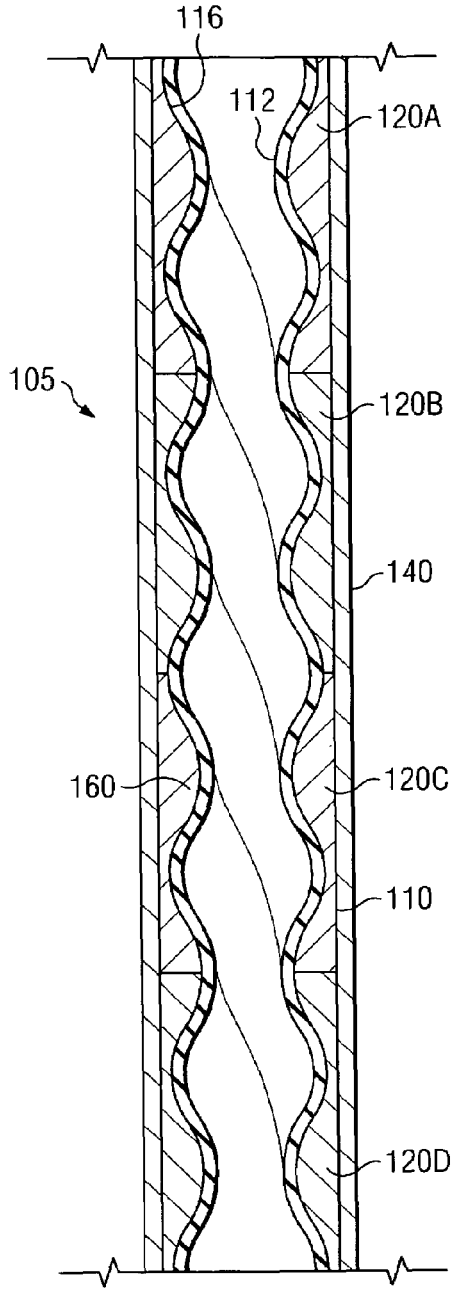
FIG. 2 depicts a portion of the stator shown on FIG. 1 in longitudinal cross section.

Turning now to FIG. 2, a portion of stator 105 is shown in longitudinal cross section. Progressing cavity stator 105 includes an outer stator tube 140 (e.g., a steel tube) retaining a comparatively rigid (preferably metallic) helical cavity component 110. Helical cavity component 110 is shaped to define a plurality of helical lobes 160 (and grooves) on an inner surface thereof. In the embodiment shown on FIG. 2, helical cavity component 110 further includes a resilient elastomer liner 112 deployed on inner surface 116 thereof.

As further shown on FIG. 2, helical cavity component 110 includes a plurality of longitudinal sections 120A, 120B, 120C, and 120D, which are referred to collectively as 120A-D, deployed end-to-end in the stator tube 140. In the exemplary embodiment illustrated on FIG. 2, the sections 120A-D are substantially identical and are rotationally aligned with one another in the tube 140 such that the helical lobes 160 extend substantially continuously from one end of the stator 105 to the other. It will be appreciated, however, that the invention is not limited to substantially identical sections 120A-D. Other embodiments may include, for example, a series of sections, which, while not substantially identical, may be concatenated in predetermined fashion into a desired stator. Returning to the embodiment of FIG. 2, stator 105 may include substantially any suitable number of sections 120A-D. In exemplary embodiments in which the concatenated sections 120A-D extend from substantially one longitudinal end of the stator 105 to the other, the stator typically includes from about 5 to about 20 sections 120A-D. As described in more detail below with respect to FIG. 6, the invention is not limited to stator embodiments in which a plurality of concatenated stator sections extend from one longitudinal end of the stator to the other. Sections 120A-D may also have substantially any suitable length, but typically have a length in the range from about 15 to about 60 centimeters (6 to 24 inches). For example, in one serviceable embodiment, a two and a half turn power section configured for subterranean drilling applications includes 10 sections each having a length of about 28 centimeters (11 inches) and an internal helical angle of 90 degrees.

Figure 3A:
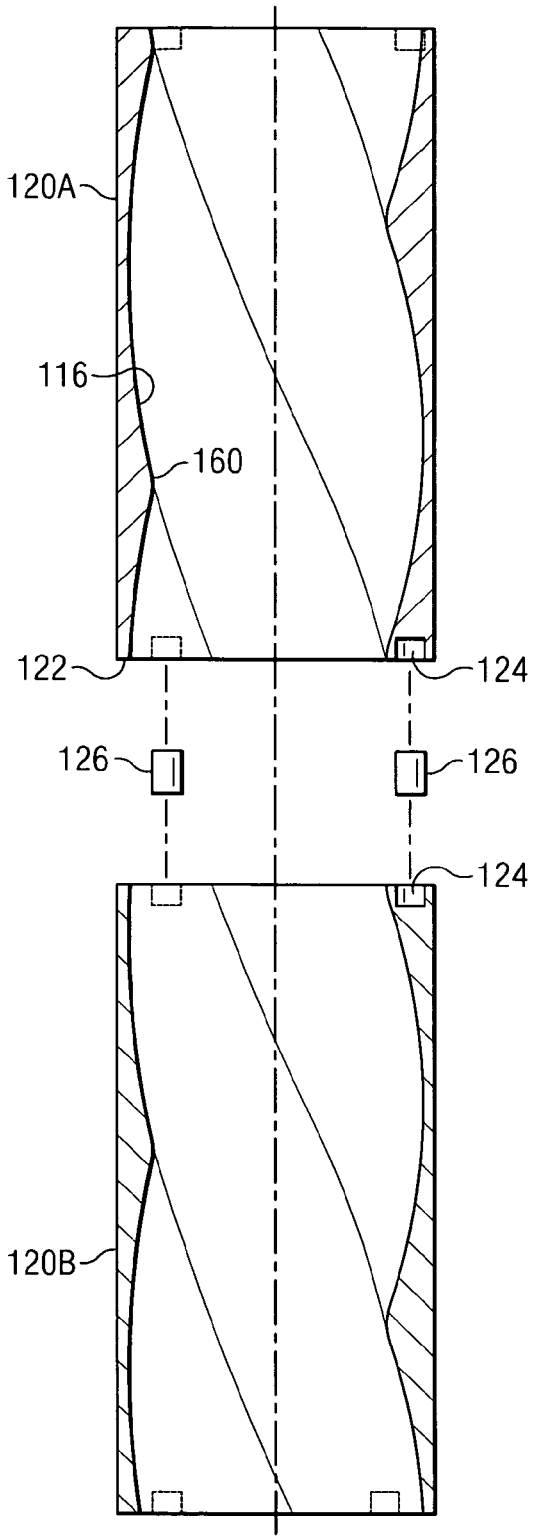
FIG. 3A depicts first and second cast stator sections in longitudinal cross-section.
Figure 3B:
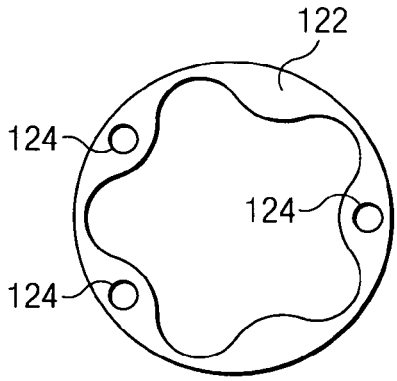
FIG. 3B is an axial view of the stator section 120A shown on FIG. 3A.

Turning now to FIG. 3A, stator sections 120A and 120B are shown in an exploded longitudinal cross section. As described above, stator sections 120A and 120B include a plurality of helical lobes 160 formed in the inner surface 116 thereof. Exemplary stator sections 120A and 120B further include a plurality of holes 124 formed in the axial faces 122 thereof. For example only, as shown on FIG. 3B, which depicts an end view of stator section 120A, stator sections 120A and 120B include holes 124 formed in three of the lobes in each axial face 122. The holes 124 are sized and shaped to receive dowel pins 126 upon end-to-end deployment of the stator sections 120A and 120B. The use of such dowel pins 126 advantageously enables the stator sections 120A and 120B to be rotationally aligned with one another to form continuous helical lobes 160. Moreover, the dowel pins 126 are further intended to substantially prevent rotation of one or more of the stator sections with respect to others. It will be understood that the use of dowel pins and corresponding holes in some embodiments as described herein is exemplary, and that in such embodiments, other types of conventional keys and rotational locators may be substituted with equivalent effect. Moreover, as described in more detail below, the stator sections may be threaded onto a helical mandrel and thus do not necessarily include rotational locators, such as dowel pins 126. Furthermore, in the exemplary embodiment shown on FIG. 3B, stator sections 120A and 120B include five helical lobes 160. It will be appreciated that this depiction is purely for illustrative purposes only, and that the present invention is in no way limited to any particular number of helical lobes 160.

While this invention is not limited to the use of any particular techniques used for the fabrication of the stator sections, the use of cast stator sections has been found to advantageously reduce manufacturing costs. In certain advantageous embodiments, stator sections (e.g., stator sections 120A-D shown on FIG. 2) are preferably cast from a steel or aluminum alloy, for example, using conventional investment casting techniques. In such embodiments, the outer surface of the cast stator sections may be ground (or machined) to predetermined dimensions and tolerances prior to final stator assembly. The stator sections may then be deployed and secured in a stator tube, for example, as described in more detail below. In certain embodiments, such as those in which a positive interference stator is desirable, an elastomer liner is then deployed on the inner surface of the stator. To form the elastomer liner a helical stator core may be deployed substantially coaxially in the stator sections and a suitable elastomer material injected into the helical cavity between the stator core and the stator sections. Elastomer injection is described in more detail below for one exemplary embodiment of this invention.

Referring again to FIG. 2, stator sections 120A-D are sufficiently secured in the stator tube 140 in order to support the high torques typically experienced in downhole power section applications. In one suitable embodiment, the stator tube 140 may be shrunk fit about the stator sections 120A-D. Such a shrink fit also typically restrains the stator sections 120A-D from relative axial rotation. To construct such an embodiment, the stator sections 120A-D may first be concatenated end-to-end (e.g., as shown for sections 120A and 120B on FIG. 4) and then deployed in a preheated stator tube (e.g., a stator tube heated to a temperature in the range from about 300 to about 400 degrees C.). Alternatively, the stator sections 120A-D may be threaded onto a helical mandrel having an outer helical profile that substantially matches the helical lobes 160 (and grooves) on the inner surface of the stator sections 120A-D. In certain exemplary embodiments the helical mandrel may advantageously facilitate deployment of the stator sections into the stator tube 140. Sliding the stator sections 120A-D down an incline (e.g., an incline of approximately 10 to 20 degrees from horizontal) into the stator tube 140 may further facilitate deployment of the stator sections 120A-D into the stator tube 140, although the invention is not limited in this regard. Moreover, it will be appreciated that the outer surface of the stator sections may be coated with a lubricant. Upon cooling, the stator tube 140 contracts about the stator sections 120A-D, thereby forming a tight shrink fit and securing the stator sections 120A-D in place in the stator tube 140. In embodiments utilizing a helical mandrel, the helical mandrel is typically removed from the stator sections 120A-D after cooling of the stator tube 140.

It will be appreciated that deploying the stator sections on a helical mandrel rotationally aligns the stator sections such that each of the internal lobes 160 extends in a substantially continuous helix from one longitudinal end of the concatenated stator sections to the other. In such embodiments, the use of dowel pins or other rotational locators is typically not necessary. Moreover, the use of a helical mandrel enables stator sections having different lengths to be concatenated end-to-end. As stated above, such a helical mandrel has an outer helical profile that substantially matches the internal helical profile of the stator sections. It will be appreciated by the artisan of ordinary skill that the outer diameter of the helical mandrel is typically slightly less than the inner diameter of the stator sections to facilitate insertion and removal of the helical mandrel from the stator sections. For example, in one exemplary embodiment the nominal diameter of the helical mandrel is approximately ninety thousands of an inch less than the inner diameter of the stator sections, although the invention is not limited in this regard.

Figure 4A:
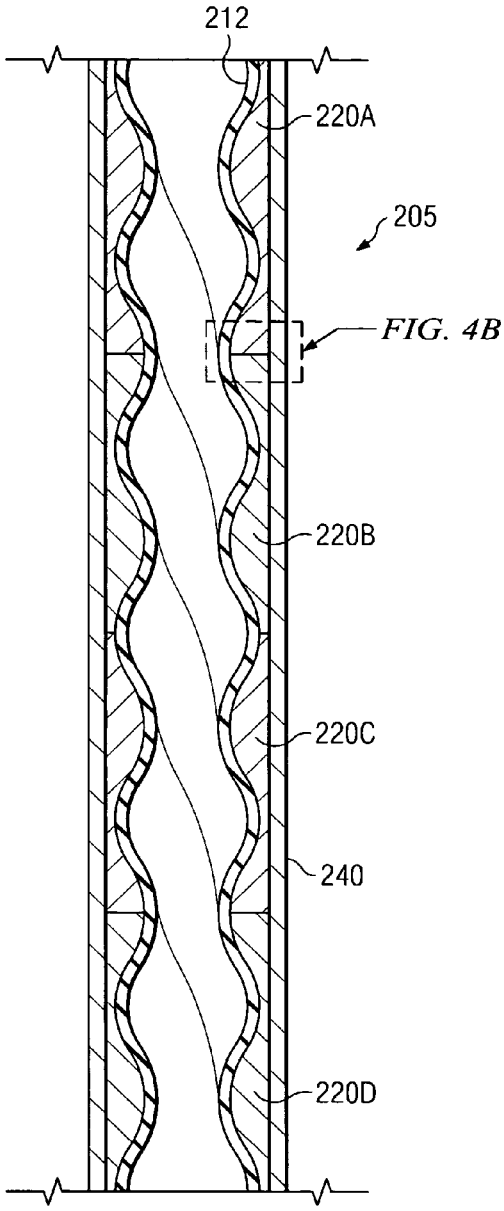
FIGS. 4A and 4B depict an alternative embodiment of a stator according to this invention including a thin elastomer layer between the stator sections and the stator tube.
Figure 4B:
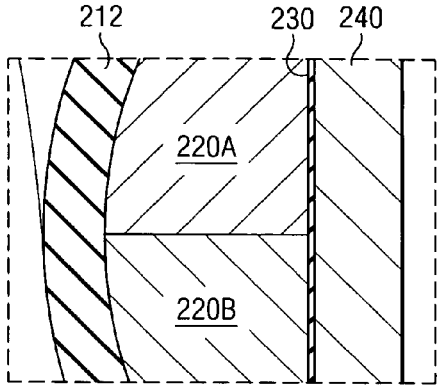
Figure 4C:
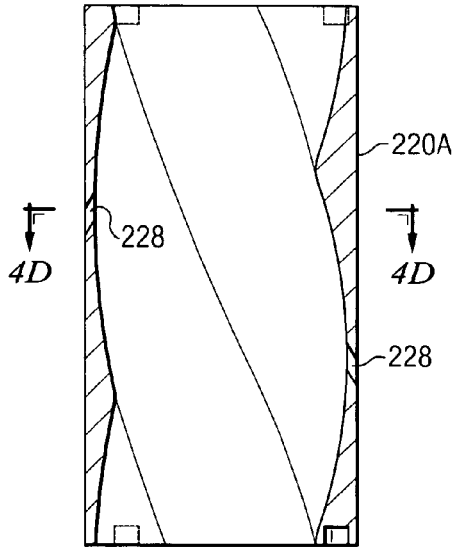
FIGS. 4C and 4D depict longitudinal and circular cross sections of stator section 220A shown on FIG. 4A.
Figure 4D:
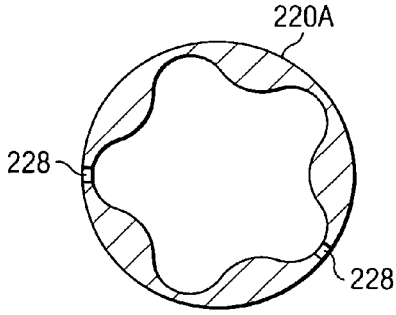

It has been found that stator sections may alternatively be secured in a stator tube by a thin elastomer layer injected between the stator sections and the stator tube. Referring now to FIGS. 4A and 4B, one alternative stator embodiment 205 according to this invention is shown. Stator 205 is similar to stator 105 (shown on FIG. 2) with an exception that it includes a thin elastomer layer 230 (FIG. 4B) formed between an outer surface the stator sections 220A, 220B, 220C, and 220D (referred to collectively as 220A-D) and the stator tube 240. Elastomer layer 230 is typically formed and cured simultaneously with that of elastomer liner 212. As stated above, elastomer liner 212 may be formed by deploying a helical stator core coaxially in the concatenated stator sections and a suitable elastomer material injected into the helical cavity between the stator core and the concatenated stator sections. In one exemplary embodiment, stator sections 220A-D include small ports 228 (shown on FIGS. 4C and 4D for stator section 220A) disposed to promote flow of the injected elastomer from the helical cavity between the stator core and the stator sections 220A-D to a thin annular cavity located between the stator sections 240A-D and the stator tube 240. It will be appreciated that the inner surface of stator tube 240 and the outer surfaces of stator sections 220A-D may be coated with a bonding compound (e.g., an adhesive) prior to injection of the elastomer material to promote bonding between the elastomer and stator tube 240 and between the elastomer and the stator sections 220A-D. Suitable bonding compounds include, for example, Lord Chemical Products Chemlock 250 or Chemlock 252X. In certain embodiments it may be advantageous to utilize aqueous based adhesives, such as Lord Chemical Products 8007, 8110, or 8115 or Rohm and Haas 516EF or Robond® L series adhesives.

It will be appreciated that elastomer layer 230 is thin relative to the other components in stator 205 (e.g., relative to elastomer liner 212). In one exemplary embodiment stator sections 220A-D are sized and shaped to be slidably received in the stator tube 240, with elastomer layer 230 being formed therebetween. In such embodiments, elastomer layer 230 typically has an average thickness in the range of from about 0.1 to about 1 millimeter (about 4 to about 40 thousands of an inch), although the invention is not limited in this regard. It will also be appreciated that there is a tradeoff in selecting an optimum elastomer layer 230 thickness (or thickness range). On one hand, if the annular cavity between the stator sections 220A-D and the stator tube 240 is too thin, the elastomer material (which is typically somewhat viscous) may not completely fill the cavity. The elastomer layer may then tend to acquire voids, cracks, and/or other defects and thus not support high torque. On the other hand, if the elastomer layer 230 is too thick it may be too resilient to adequately support high torque.

Figure 5:
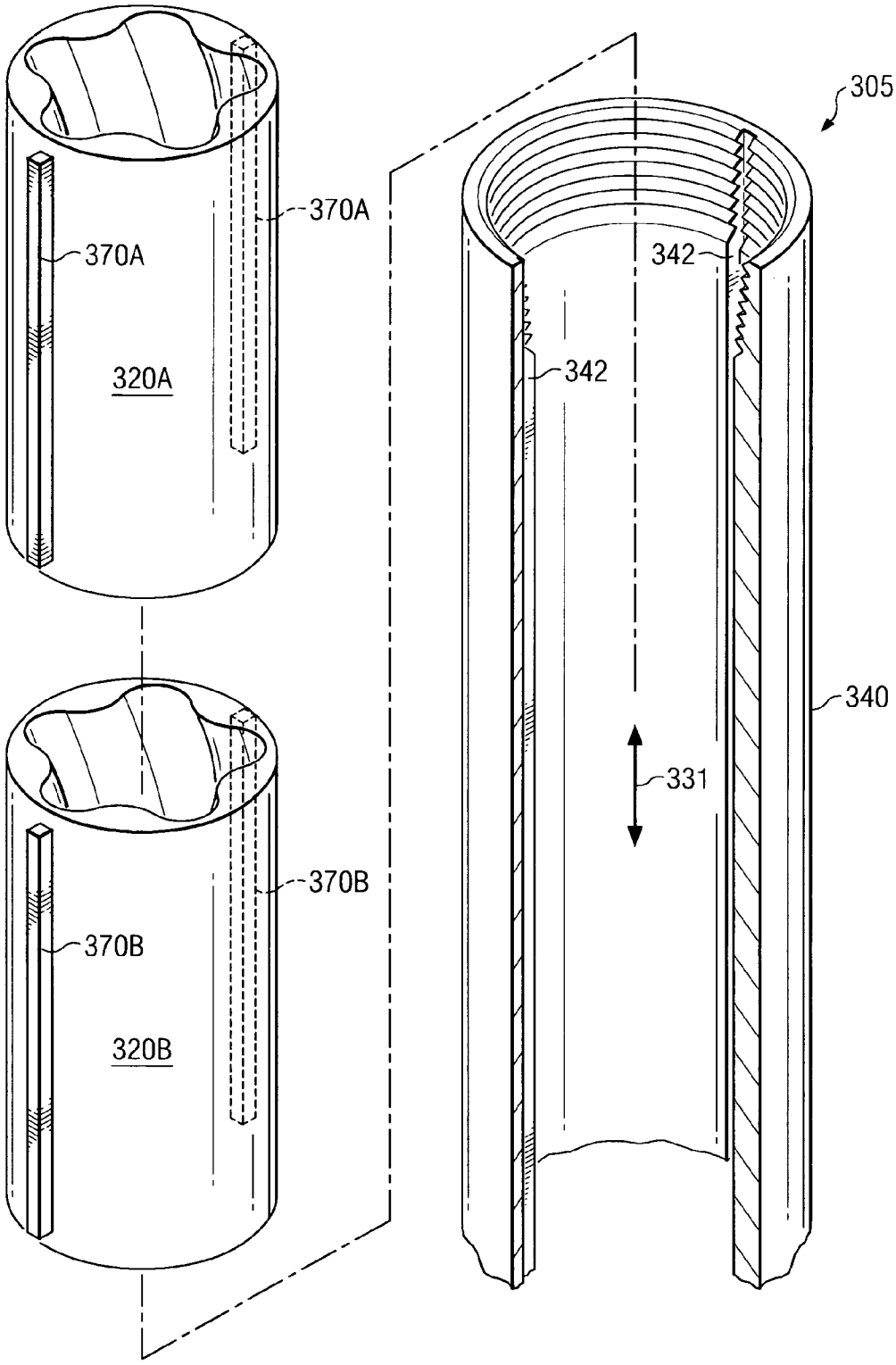
FIG. 5 depicts another alternative embodiment of a stator according to this invention in which the stator sections include an axial spline, the spline sized and shaped to engage an axial groove on the stator tube.

Referring now to FIG. 5, in another alternative embodiment, one or more stator sections 320A and 320B (referred to collectively as 320A-B) may be secured in stator tube 340 by at least one axial spline 370A and 370B, formed on the outer surface of each of the corresponding stator sections 320A-B, and corresponding axial grooves 342 formed on the inner surface of the stator tube 340. Axial splines 370A and 370B may be formed, for example, during casting of the stator sections 320A-B, while axial grooves may be formed via machining the inner surface of stator tube 340, however the invention is not limited in these regards. Stator sections 320A-B are deployed in stator tube 340 such that splines 370A and 370B engage grooves 342, thereby substantially preventing stator sections 320A-B from rotating relative to one another and to the stator tube 340. The stator sections 320A-B may then be held in place in stator tube 340, for example, via a threaded end cap (not shown) or some other suitable arrangement. Exemplary embodiments of stator 305 advantageously enable stator sections 320A-B to be removed from stator tube 340 as shown at 331. In the event of elastomeric degradation, for example, one or more of the stator sections 320A-B may be removed from the stator tube 340 and replaced with other similar stator sections 320A-B in the field (e.g., at a drilling rig) typically providing significant savings in time and expense.

Stator 305 is similar to stators 105 (FIG. 2) and 205 (FIG. 4) in that it includes an elastomer liner (not shown) deployed on an inner surface of the helical cavity component (inner surface 316 of stator sections 320A-B in the embodiment shown on FIG. 5). In the exemplary embodiment shown on FIG. 5, an elastomer liner may be deployed as described above via known elastomer injection and curing techniques after deployment of the stator sections 320A-B in stator tube 340. Alternatively, each stator section 320A-B may be fitted with an elastomer liner (not shown on FIG. 5) on the inner surface thereof prior to deployment in the stator tube 340.

Figure 6:
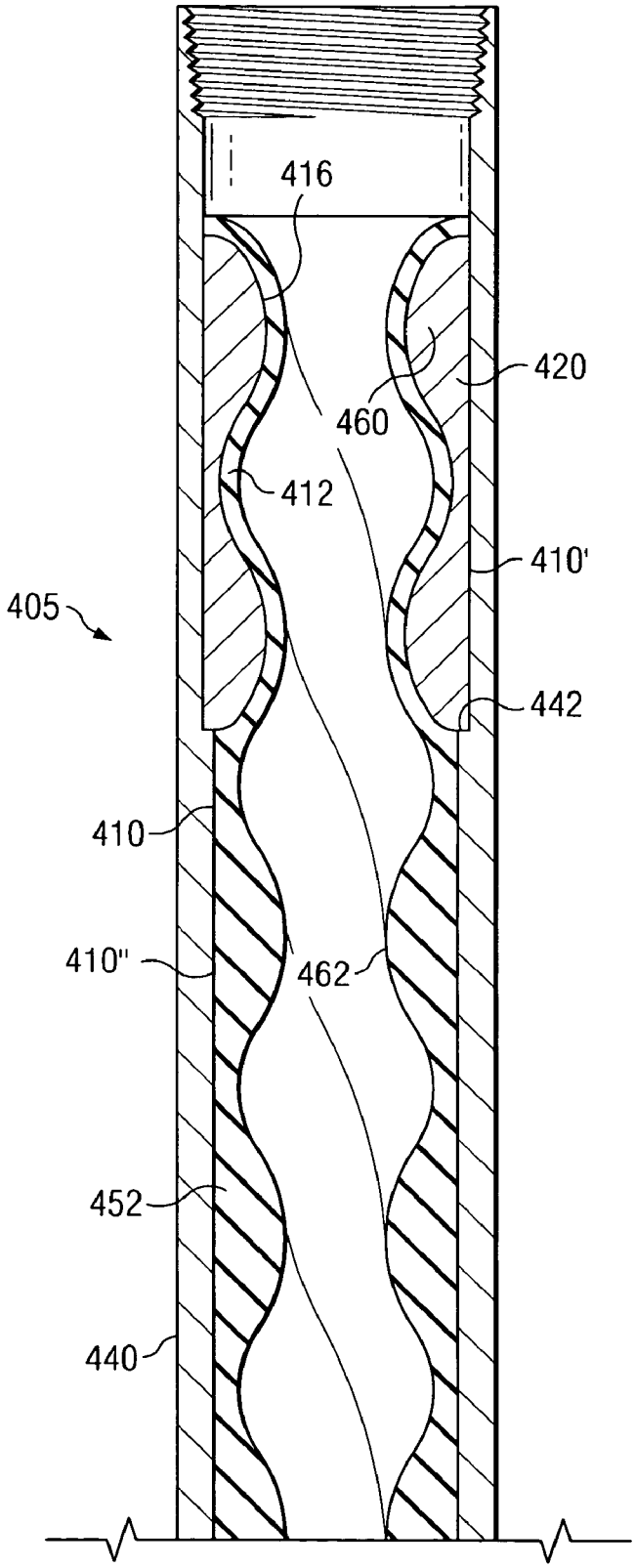
FIG. 6 depicts still another alternative embodiment of a stator according to this invention.

Turning now to FIG. 6, another alternative embodiment of a stator 405 according to this invention is illustrated. Stator 405 is similar to stators 105, 205, and 305 (described above with respect to FIGS. 2 through 5) in that it includes at least one longitudinal stator section 420 deployed in a stator tube 440. Moreover, the at least one stator section 420 is similar to stator sections 120A-D, 220A-D, and 320A-B (also described above with respect to FIGS. 2 through 5) in that it includes a plurality of helical lobes 460 formed in the inner surface 416 thereof. Stator 405 differs from those described above in that the stator sections do not extend from one longitudinal end of the stator 405 to the other. Rather, in the exemplary embodiment shown, stator 405 includes a single stator section 420 deployed at one end 407 of the stator 405 (e.g., the downhole hole end). It will be appreciated that this invention is not limited to stator embodiments including only a single stator section 420, but that stator 405 may also include a plurality of concatenated stator sections deployed at one end thereof. Moreover, stator 405 may alternatively include one or more stator sections 420 deployed at each longitudinal end of the stator.

With continued reference to FIG. 6, stator 405 includes an outer stator tube 440 retaining a helical cavity component 410. Helical cavity component 410 includes at least one rigid stator section 420. In the exemplary embodiment shown, stator section 420 reinforces a first portion 410' of the helical cavity component 410 while a second portion 410" of the helical cavity component 410 is of an all elastomer construction as shown at 452. Stator 405 further includes an elastomer liner 412 deployed on internal surface 416 of stator section 420. The elastomer liner 412 is continuous with elastomer layer 452 such that the stator 405 includes a plurality of stator lobes 462 extending substantially continuously from one longitudinal end of the stator 405 to the other.

Exemplary embodiments of stator 405 may be fabricated, for example, as described above with respect to stators 105, 205, and 305. In one suitable embodiment, the stator tube 440 may be shrunk fit about the at least one stator section 420. In exemplary embodiments including a plurality of stator sections, the sections may first be concatenated end-to-end (as described above) prior to deployment in the stator tube 440. Stator tube 440 may advantageously include a shoulder 442 against which the at least one stator section 420 is deployed. After deployment of section 420 in the stator tube 440, a stator core may be deployed substantially coaxially in the stator tube 440 and elastomer injected into the helical cavity between the core and the stator tube 440. The stator core is then removed and the elastomer cured, e.g., in a steam autoclave.

With further reference to FIG. 6, stator 405 may be advantageous for various applications in that it provides a relatively cost effective rigid reinforcement to a portion of helical cavity component 410 (as compared to providing rigid reinforcement along the entire length of the stator). For example only, in some downhole drilling applications, conventional stators having an all elastomer helical cavity component are known to fail frequently at the downhole end of the stator. Such failures tend to characterize, in some applications, a "zone of high stress" at the downhole end of the stator. This "zone of high stress" may result, for example, from increased loads on the stator due to the eccentric path of the rotor at the downhole end thereof. Moreover, the pressure drop of the drilling fluid per stator stage is also known to be greatest in some applications at or near the downhole end of the stator. It will be appreciated that exemplary embodiments of stator 405 are configured to provide additional rigidity and reinforcement at the above-described "zone of high stress" of stators in such applications (e.g., at or near the downhole end of the stator). Exemplary embodiments of stator 405 may thus provide a cost effective approach for improving torque output and/or stator longevity. It will also be appreciated that in other applications, additional stator rigidity and reinforcement may be advantageous at other locations along the stator (e.g., at the uphole end and/or at some other location between the two stator ends).

Although the present invention and its advantages have been described in detail, it should be understood that various changes, substitutions and alternations can be made herein without departing from the spirit and scope of the invention as defined by the appended claims.

We claim:

1. A stator for use in a progressing cavity power section, the stator comprising:

an outer stator tube including a longitudinal axis;

a helical cavity component deployed substantially coaxially in the stator tube, the helical cavity component including a plurality of substantially rigid longitudinal stator sections concatenated end-to-end in the stator tube;

a thin elastomer layer having a substantially uniform thickness deployed between an outer surface of the stator sections and an inner surface of the stator tube, the thin elastomer layer disposed to substantially prevent rotation of the stator sections about the longitudinal axis relative to the stator tube;

each of the stator sections providing an internal helical cavity and including a plurality of internal lobes;

the stator sections rotationally aligned with one another so that each of the internal lobes extends in a substantially continuous helix from one longitudinal end of the stator to an opposing longitudinal end of the stator, the stator sections rotationally restrained to substantially prevent relative rotation of the stator sections about the longitudinal axis;

the helical cavity component further including a continuous elastomer liner deployed on an inner surface of the concatenated stator sections.

2. The stator of claim 1, wherein the stator sections comprise cast stator sections.

3. The stator of claim 1, wherein the helical cavity component comprises from about 5 to about 20 stator sections, each having a length in a range from about 15 to about 60 centimeters.

4. The stator of claim 1, wherein the thin elastomer layer has a thickness in the range from about 0.1 to about 1 millimeter.

5. The stator of claim 1, further comprising a bonding compound deployed on the outer surface of the stator sections and the inner surface of the stator tube.

6. The stator of claim 1, wherein the stator sections are sized and shaped to be slidably received in the stator tube.

7. The stator of claim 1, wherein through holes are formed in the stator sections, the through holes sized and shaped to promote flow of injected elastomer during forming of the elastomer liner and the thin elastomer layer.

8. The stator of claim 1, wherein the stator sections include a plurality of holes formed in each axial face thereof, the holes disposed to receive dowel pins upon said end-to-end concatenation of the stator sections in the stator tube, the dowel pins disposed to restrain adjacent stator sections from relative rotation.

9. A subterranean drilling motor comprising:

a rotor having a plurality of rotor lobes on a helical outer surface of the rotor;

a stator including a helical cavity component having a plurality of substantially rigid longitudinal stator sections concatenated end to end in the stator, the stator sections providing an internal helical cavity and including a plurality of internal lobes, the stator sections rotationally aligned with one another so that each of the internal lobes extends in a substantially continuous helix from one longitudinal end of the stator to an opposing longitudinal end of the stator;

the stator sections substantially restrained from relative rotation (1) between the stator sections and the stator tube, and (2) between each other;

the helical cavity component further including a continuous elastomer liner deployed on an inner surface of the concatenated stator sections;

the rotor deployable in the helical cavity of the stator such that the rotor lobes are in a rotational interference fit with the elastomer liner;

wherein the stator sections are secured in an outer stator tube by an elastomer layer having a substantially uniform thickness in the range from about 0.1 to about 1 millimeter deployed between the stator sections and the stator tube, the elastomer layer providing, at least in part, said substantial restraint of the stator tubes from relative rotation.

10. A stator for use in a progressing cavity power section, the stator comprising:

an outer stator tube including a longitudinal axis;

a helical cavity component deployed substantially coaxially in the stator tube, the helical cavity component including first and second longitudinal portions;

the first longitudinal portion including at least one substantially rigid longitudinal stator section deployed in the stator tube, the at least one stator section retained by and secured in the stator tube to substantially prevent rotation of the at least one stator section about the longitudinal axis relative to the stator tube, the first portion further including an elastomer liner deployed on an internal helical surface of the at least one stator section;

the second longitudinal portion of the helical cavity component consisting of an elastomer layer deployed in and retained by the stator tube;

the elastomer liner in the first portion being substantially continuous with the elastomer layer in the second portion such that the helical cavity component provides an internal helical cavity, wherein the helical cavity component includes a plurality of lobes, each of the lobes extending in a substantially continuous helix from one longitudinal end of the stator to another longitudinal end of the stator.

11. The stator of claim 10, wherein the first portion of the helical cavity component is located substantially at one longitudinal end of the stator.

12. The stator of claim 10, wherein the first portion of the helical cavity component comprises a plurality of concatenated cast stator sections, the cast stator sections rotationally restrained to substantially prevent relative rotation of the stator sections about the longitudinal axis.

13. The stator of claim 10, wherein the at least one stator section abuts a shoulder formed on an inner surface of the stator tube.

14. The stator of claim 10, wherein the at least one stator section has a length in a range from about 15 to about 60 centimeters.

15. The stator of claim 10, wherein the at least one stator section is secured in the stator tube by heat shrinking the stator tube about the stator section.

16. The stator of claim 10, wherein the at least one stator section is secured in the stator tube by a thin elastomer layer deployed between the stator section and the stator tube.

17. The stator of claim 10, wherein the at least one stator section is secured in the stator tube by engagement of at least one spline formed on an outer surface of the at least one stator section with a corresponding groove formed on an inner surface of the stator tube.

18. A subterranean drilling motor comprising:

a rotor having a plurality of rotor lobes on a helical outer surface of the rotor;

a stator including:

an outer stator tube including a longitudinal axis;

a helical cavity component deployed substantially coaxially in the stator tube, the helical cavity component including first and second longitudinal portions;

the first longitudinal portion including at least one substantially rigid longitudinal suitor section deployed in the stator tube, the at least one stator section retained by and secured in the stator tube to substantially prevent rotation of the at least one stator section about the longitudinal axis relative to the stator tube, the first portion further including an elastomer liner deployed on an internal helical surface of the at least one stator section;

the second longitudinal portion of the helical cavity component consisting essentially of an elastomer layer deployed in and retained by the stator tube;

the elastomer liner in the first portion being substantially continuous with the elastomer layer in the second portion such that the helical cavity component provides an internal helical cavity, wherein the helical cavity component includes a plurality of lobes, each of the lobes extending in a substantially continuous helix from one longitudinal end of the stator to another longitudinal end of the stator; and the rotor deployable in the helical cavity of the stator such that the rotor lobes are in a rotational interference fit with the elastomer liner in the first portion and the elastomer layer in the second portion.

* * * * *